United States Patent [19]

Koyama et al.

[11] Patent Number: 4,696,678

[45] Date of Patent: Sep. 29, 1987

[54] METHOD AND EQUIPMENT FOR GASIFICATION OF COAL

[75] Inventors: Shuntaro Koyama; Hiroshi Miyadera, both of Hitachi; Tomohiko Miyamoto, Takahagi, all of Japan

[73] Assignee: Agency of Industrial Science and Technology, Tokyo, Japan

[21] Appl. No.: 663,813

[22] Filed: Oct. 22, 1984

Related U.S. Application Data

[63] Continuation of Ser. No. 353,902, Mar. 2, 1981, abandoned.

[30] Foreign Application Priority Data

Mar. 6, 1981 [JP] Japan ..... 56-31120

[51] Int. Cl.[4] ..... C10J 3/54

[52] U.S. Cl. ..... 48/201; 48/200; 48/203; 48/206

[58] Field of Search ..... 48/202, 203, 206, 200, 48/201

[56] References Cited

U.S. PATENT DOCUMENTS

| | | | |
|---|---|---|---|
| 2,677,603 | 5/1954 | Van Loon | 48/203 |
| 2,729,552 | 1/1956 | Nelson et al. | 48/206 |
| 2,803,530 | 8/1957 | Ludeman | 48/206 |
| 3,454,383 | 7/1969 | Pirsh et al. | 48/203 |
| 4,113,615 | 9/1978 | Gobarty | 55/85 |

*Primary Examiner*—Peter Kratz

*Attorney, Agent, or Firm*—Birch, Stewart, Kolasch & Birch

[57] ABSTRACT

A method for the gasification of coal in a fluidized bed gasifier to improve gasification efficiency comprising the steps of introducing coal into the thermal cracking zone of a fluidized bed gasifier, thermally cracking and partially combusting the coal in said gasifier, recovering a fluid product gas containing fine particles therein from the fluidized bed gasifier, separating the fine particles as char from the first product gas, gasifying said recovered fine char particles at a temperature higher than its melting point in a high temperature gasifier to produce ash and a second product gas having $H_2$ and CO as its main components, recovering the ash as a slag and feeding the second product gas containing $H_2$ and CO to the coal feeding position of the fluidized bed gasifier in the thermal cracking zone.

2 Claims, 4 Drawing Figures

METHOD AND EQUIPMENT FOR GASIFICATION OF COAL

This application is a continuation of application Ser. No. 353,902 filed on Mar. 2, 1982, and now abandoned.

TECHNICAL FIELD

The present invention relates to a method and apparatus for gasification of coal, especially to a method and apparatus utilizing a fluidized bed in which efficient gasification and treatment of fine dusts produced in pulverizing coal are obtainable.

BACKGROUND ART

Substitute energies for oil are now being developed all around the world. Among them, a process to produce industrial gas rich in methane ($CH_4$), hydrogen ($H_2$) and carbon monooxide (CO) by gasifying coal, or a process to produce synthetic natural gas by methanation of these gases are regarded as promising. Especially a gasifying method utilizing a fluidized bed is superior to other methods in scale up and operatability and has possibility as a practical gasifier.

As a form of gasification, it is most reasonable from the viewpoint of efficient use of heat to carry out carbonization and partial combustion of char produced in carbonization at the same time. In this partial combustion system utilizing a fluidized bed, it is most important for improving gasification efficiency to effectively treat fine dusts and prevent calorie decrease caused by excessive $CO_2$ (carbon dioxide).

Coal particles pulverized into less than several mm diameter are generally used in the fluidized bed gasifier and the fine particles hve a wide particle distribution size as shown in FIG. 1. Particularly fine dusts below several hundred microns entrained with gas from the fluidized bed gasifier cause plugging in the gas purification section. In addition, not only is it intricate to transporting, after collecting by a cyclone separator, but also it brings about carbon loss because it is not fully gasified, and, as a whole, the gasification efficiency is lowered.

Therefore, fine coal is separated and removed before it is supplied to the gasifier and it is used for other purposes such as a fuel for generating steam.

It is also practiced, in order to improve gasification efficiency to put back the fine char collected from product gas by a cyclone separator and to carbonize (thermal cracking) it with raw material.

However, in the first method, various pollution problems arise such as fly ash being dispersed into the air and air pollution caused by harmful matters in the exhausted gas. As a countermeasure to a large scale pollution, a prevention system is required and as a result the gasification cost will be raised.

In a second method of putting back the collected char into the gasifier, ash produced by combustion is again exhausted and dispersed, and as a result, it circulates between the gasifier and the cyclone separator and is retained within the gasification equipment. In this case, not only the ash but also the collected char in one path are contained in the fine dusts circulating in the gasification equipment. So, if they are exhausted out of the equipment, it brings about carbon loss. On the other hand, there is a method for gasifying only fine pulverized coal in an air stream, but this method is adopted for producing raw material gas consisting mainly of $H_2$ and CO and is not adequate for producing high calorific gas.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DISCLOSURE OF THE INVENTION

The present invention intends to improve the gasification efficiency by introducing char entrained from fluidized bed gasifier to another high temperature gasifier, in which the char is decomposed mainly into $H_2$ and CO by high temperature partial combustion and by feeding the product gas to the thermal cracking zone of the fluidized bed gasifier on the basis of the experimental facts that, the higher the $H_2$ consistency or the lower the $CO_2$ consistency in the partial combustion gas produced in the partial combustion zone, the more $CH_4$ is produced in thermal cracking.

The above partial combustion gas is the atmospheric gas of the thermal cracking zone.

Figure 2:
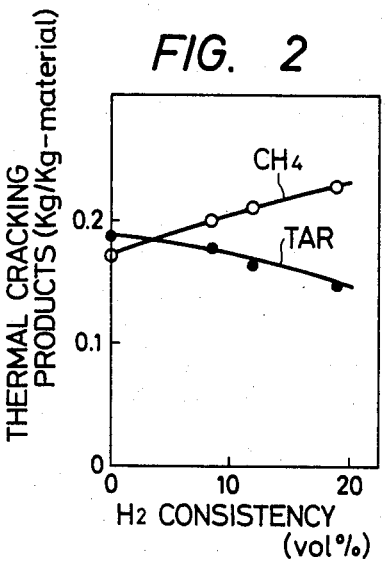
FIG. 2 is a diagram showing the change of the producing quantity of thermal cracking products ($CH_4$ and tar) in comparison with $H_2$ consistency in the thermal cracking zone (in case of steam base)
Figure 3:
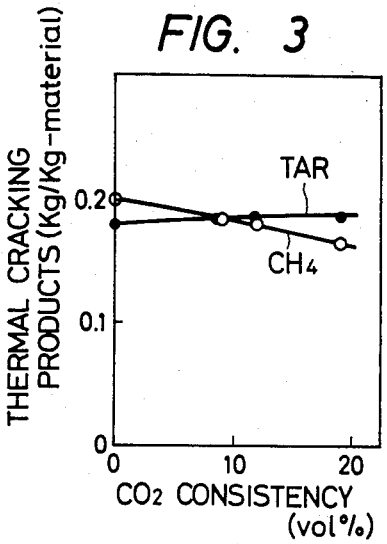
FIG. 3 is a diagram showing change in amount of thermal cracking products ($CH_4$ and tar) in comparison with the change of $CO_2$ consistency in the thermal cracking zone (the base with 9.5 vol% of $H_2$ and steam for the rest)

FIG. 2 and FIG. 3 are the results obtained by measuring gas produced by thermal cracking of coal residual oil (asphalt) mixture under a temperature (T)=750° C., and a pressure (P)=30 kg/cm$^2$G.

According to FIG. 2, it is known that, by increasing $H_2$ consistency in atmospheric gas, $CH_4$ increases and at the same time tar decreases, with thermal cracking being promoted. With the increase of $H_2$ consistency, $H_2O$ (steam) consistency decreases relatively and $CO_2$ produced by the shift reaction shown in the following equation (1) is restrained.

$$CO + H_2O \rightleftharpoons CO_2 + H_2 \quad (1)$$

On the other hand, as shown in FIG. 3, at a definite $H_2$ consistency ($H_2$=9.5 vol%), if $CO_2$ increases, $CH_4$ decreases, because, in proportion to the increase of $CO_2$ consistency, the $H_2O$ (steam) consistency decreases, and the reforming reaction shown in the following (2) equation is restrained, and $CH_4$ generation is restrained with a decrease in $H_2$ generation.

$$C_XH_Y\,(tar) + H_2O \rightarrow H_2 + CO \quad (2)$$

The above result indicates that the composition of partial combustion gas to form atmospheric gas of thermal cracking zone should have preferably high $H_2$ consistency and low $CO_2$ consistency. As is well known, however, in the composition of partial combustion gas, the equilibrium composition of equation (1) is dominant and it is impossible to freely raise the $H_2$ consistency in the partial combustion gas.

It is also known that most of the fine pulverized coal can be converted to $H_2$ and CO by high temperature partial combustion of fine coal in entrained bed. The invention is aimed at separating fine particle char in product gas from the fluidized bed gasifier by a cyclone separator introducing the separated char into another high temperature gasifier where gasifying agents such as $O_2$ and $H_2O$, etc. are added and conducting partial combustion at a temperature higher than the melting point of the ash to produce a gas consisting of mainly $H_2$ and CO, which is introduced to the thermal cracking zone in the fluidized bed gasifier and raises the $H_2$ consistency of the atmospheric gas of the thermal cracking zone so that the thermal cracking is accelerated.

Accordingly, the present invention offers a gasification method of a coal which comprises recovering fine particle char in the product gas from a fluidized bed gasifier, gasifying the recovered fine particle char at a temperature higher than the melting point of the ash of the fine particle char, recovering ash contained in the fine particle char as slag and feeding the product gas from the high temperature gasifier to the coal feeding position of the fluidized bed gasifier.

In other words, the invention offers a gasifier of coal which is provided with a fluidized bed gasifier where fuel containing coal and gaseous reactants containing oxygen and steam are fed and thermal cracking is produced, and a cyclone separator separates the product gas from the fluidized bed gasifier into fuel gas and fine particle char; a high temperature gasifier to gasify the fine char fed from the cyclone separator with gaseous reactants containing oxygen and steam at higher temperature than melting point of the ash; a means to feed product gas from the high temperature gasifier to the coal feeding position of the fluidized bed gasifier and a means for recovering the ash separated in the high temperature gasifier as slag.

BEST MODE FOR CARRYING OUT THE INVENTION

The embodiment of the present invention will be described by referring to FIG. 4.

Figure 1:
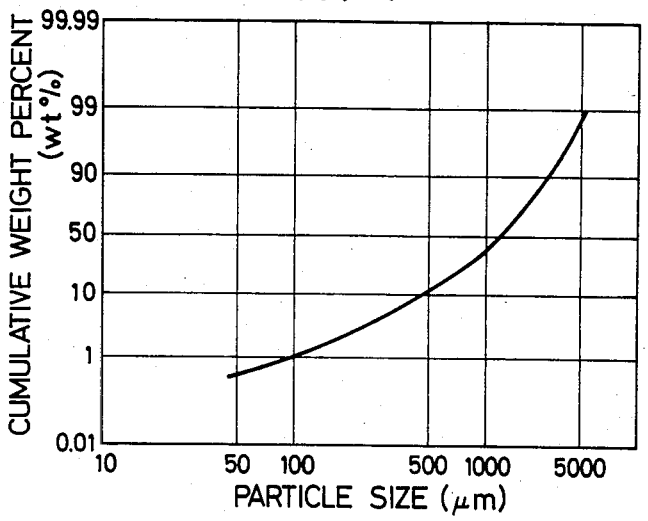
FIG. 1 is a diagram exemplifying the distribution of the particle size distribution of the pulverized coal, namely the distribution of cumulative weight percentage in comparison with the particle sizes.
Figure 4:
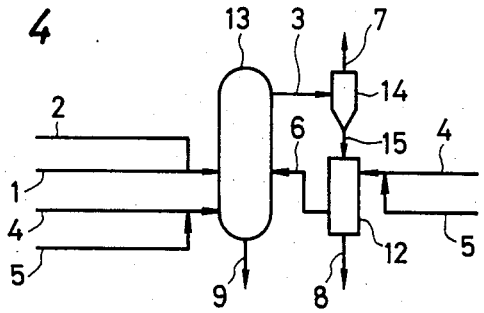
FIG. 4 is a drawing showing the whole arrangement of the coal gasification equipment according to the present invention.

In FIG. 4, coal 1 pulverized into particle size distribution shown in FIG. 1 by a conventional pulverizer is fed directly to the thermal cracking zone of the gasifier 13 without particle size adjustment. Fuel is not limited to coal only but also the mixture of the coal 1 and heavy oil 2 is usable. In the fluidized bed gasifier 13, coal is thermally cracked at first and char, tar, and thermal cracking gas are produced.

Produced char is partially burned by gaseous agents of steam ($H_2O$) 4 and oxygen (or air) 5 fed from the bottom of the fluidized bed gasifier 13, and gas whose main components are $CO_2$, CO, $H_2$ and $H_2O$ is produced. The combustionn heat obtained in this partial combustion is used as a heat source required for thermal cracking. Ash 9 which is combustion residue is exhausted from the bottom of the fluidized bed gasifier 13. Inside the fluidized bed gasifier 13, the partial combustion zone is formed below the thermal cracking zone.

Gas produced by the thermal cracking and partial combustion is exhausted from the top of the fluidized bed gasifier 13, and after being extracted as product gas, the conducted into the cyclone separator 14. Fine char 15 entrained with product gas 3 is collected by the cyclone 14 and the fine char 15 is fed to high temperature gasifier 12. Steam ($H_2O$) 4 and oxygen (or air) 5 is fed to high temperature gasifier 12 and, accompanying with gas, fine char 15 is gasified at such a high temperature that the ash in the char is molten. Gas which is rich in $H_2$ and CO and scanty in $CO_2$ is produced by adjusting the amount of steam and oxygen and gasifying at such high temperature.

The high temperature gas 6 produced in this way is fed at the same level with the feeding position of raw material (coal) to the fluidized bed gasifier 13. The reason for feeding at the same level with the raw material feeding position is that thermal cracking zone is formed around this and in the upper position of the fluidized bed and, if the produced high temperature gas 6 is fed to the lower position, it is fed to the partial combustion zone and $H_2$ and CO gas in the produced high temperature gas 6 are burned by $O_2$.

As described above, the thermal cracking zone temperature rises when high temperature gas 6 is fed to the thermal cracking zone and at the same time $H_2$ consistency in partial combustion gas fed to the thermal cracking zone increases to accelerate thermal cracking. In this case, if $H_2$ consistency rises, $CO_2$ consistency decreases. Fine particle char is completely gasified in the high temperature gasifier 12, ash is exhausted in molten state i.e. slag stage 8, so there is no need to consider about ash disposal problem, countermeasures to dusts or air pollution.

The thermally cracked gas 7 separated from fine char 15 in the cyclone 14 is introduced in the following gas producing section.

Table I shows comparison of two conditions; (A) when fine char from the fluidized bed gasifier is exhausted as it is and (B) when the invention is adopted. The raw material used in the two cases is slurry which is a mixture of Taiheiyo coal with particle size distribution shown in FIG. 1 and Iranian heavy residual oil at the ratio of 1 to 2. In the conventional method to exhaust fine char without any treatment as listed in (A) column temperatures of thermal cracking zone and partial combustion zone are 810° C. and 875° C., respectively, quantities of entrained char and produced tar are 1.4 kg/h and 2.4 kg/h, respectively and each ratio to raw material are 7.4 vol% and 12.7 vol%, respectively.

TABLE I

| | | A | B |
|---|---|---|---|
| Gasifier | | | |
| Raw material feeding amount | (kg/h) | 18.9 | 18.9 |
| Steam | (kg/h) | 28.5 | 28.5 |
| Oxygen | (kg/h) | 12.4 | 12.4 |
| Pressure | (kg/cm$^2$) | 3.0 | 3.0 |
| Temperature (°C.) | Thermal cracking | 810 | 845 |
| | Partial combustion | 875 | 880 |
| High temperature Gasifier | | | |
| Fine char feeding quantity | (kg/h) | | 1.4 |
| Steam | (kg/h) | | 0.4 |
| Oxygen | (kg/h) | | 0.8 |
| Pressure | (kg/cm$^2$) | | 3.0 |
| Temperature | (°C.) | | 1520 |
| Product gas | | | |
| Produced quantity | (Nm$^3$/h) | 29.4 | 31.9 |
| Composition (vol %) | $H_2$ | 29.8 | 30.6 |
| | CO | 11.2 | 14.3 |
| | $CO_2$ | 39.1 | 33.2 |
| | $CH_4$ | 14.6 | 15.8 |

TABLE I-continued

| | | A | B |
|---|---|---|---|
| | $C_2$–$C_3$ | 2.3 | 1.8 |
| Calorific value | (kcal/Nm$^3$) | 3090 | 3210 |
| Tar produced quantity | (kg/h) | 2.4 | 1.9 |
| Ash produced quantity | (kg/h) | 0.9 | 0.9 |
| Fine char or slag produced quantity | (kg/h) | 1.4: fine char | 0.8: slag |
| Gasification efficiency* | (%) | 53.2 | 57.5 |

$$\text{*Gasification efficiency} = \frac{\text{Produced gas quantity} \times \text{gas calorific value}}{\text{Material feeding amount} \times \text{material calorific value}}$$

The temperature of the high temperature gasifier becomes 1520° C. in (B) with the composition of $H_2$=28.5%, CO=39.3%, $H_2O$=21.4% and $CO_2$=10.8%. As a result of feeding high temperature gas to the fluidized bed gasifier, temperatures of the thermal cracking zone and partial combustion zone rise to 845° C. and 880° C. $CH_4$ consistency in the product gas from the fluidized bed gasifier rises from 14.6% in (A) to 15.8% of (B). And the ratio of tar product quantity to the material decreases 2.6%, so the gasification efficiency increases 4.3%.

As clear from the above description, this invention makes it possible to improve gasification efficiency even if coal is used in pulverized state, because the ash contained in fine char from gasifier is taken out from high temperature gasifier in the form of slag without any disposal problem and because high temperature gas produced by gasificating entrained fine char is fed to the thermal cracking zone.

What is claimed is:

1. A method for gasification of coal in a fluidized bed gasifier to improve gasification efficiency comprising the steps of:

introducing coal having a predetermined particle size distribution into an upper thermal cracking zone of a fluidized bed gasifier and introducing gasifying agents containing steam and an oxygen containing gas to the bottom of said fluidized bed gasifier;

thermally cracking the coal in the upper zone of the fluidized bed gasifier;

partially combusting the char, which is produced by the thermal cracking in said upper zone, and has moved down to the lower zone of the fluidized bed gasifier, in said lower zone of the fluidized bed gasifier and recovering the ash produced thereby from the bottom of the fluidized bed gasifier;

recovering a first product gas from the top of the fluidized bed gasifier which contains fine char;

separating the fine char from the first product gas;

introducing the recovered fine char together with a predetermined amount of steam and an oxygen-containing gas into a high temperature gasifier maintained at a temperature higher than the melting point of the ash constituents of the fine char to produce, by partial combustion of the fine char, a high temperature second product gas containing $H_2$ and CO as its main components and recovering the fine ash as the molten slag from the bottom of the high temperature gasifier; and feeding the high temperature second product gas containing $H_2$ and CO directly to the coal feeding portion of the fluidized bed gasifier in the thermal cracking zone to promote the thermal cracking of the coal supplied to the upper zone of the fluidized bed gasifier.

2. A method as defined in claim 1 wherein the coal also contains heavy oil.

* * * * *